United States Patent [19]

Borlinghaus

[11] 4,192,161

[45] Mar. 11, 1980

[54] ESCUTCHEON AND COVER ASSEMBLY FOR A LOCK CYLINDER

[75] Inventor: Hans J. Borlinghaus, Utica, Mich.

[73] Assignee: General Motors Corporation, Detroit, Mich.

[21] Appl. No.: 943,450

[22] Filed: Sep. 18, 1978

[51] Int. Cl.[2] ..... E05B 17/18

[52] U.S. Cl. ..... 70/455; 70/452

[58] Field of Search ..... 70/455, 452, 55, 423, 70/372, 427, 431; 150/52 K, 52 L

[56] References Cited

U.S. PATENT DOCUMENTS

| | | | |
|---|---|---|---|
| 3,898,824 | 8/1975 | Borlinghaus | 70/455 |
| 3,930,391 | 1/1976 | Borlinghaus | 70/455 |

*Primary Examiner*—Robert L. Wolfe

*Attorney, Agent, or Firm*—R. L. Phillips

[57] ABSTRACT

An escutcheon and cover assembly for a lock cylinder is provided with a spring biased pivotal arrangement and stops which cooperate to provide normal opening and closing movement of the cover for access to the lock cylinder and in addition, provide for pivotal movement of the cover in an unorthodox manner to provide access to the escutcheon for attaching same about the lock cylinder.

3 Claims, 8 Drawing Figures

ESCUTCHEON AND COVER ASSEMBLY FOR A LOCK CYLINDER

This invention relates to an escutcheon and cover assembly for a lock cylinder and more particularly to such an arrangement wherein the cover normally limits access to the escutcheon for its attachment about the lock cylinder.

In an escutcheon and cover assembly for lock cylinders and the like, it is common practice to have the attaching points of the escutcheon as well as the lock cylinder shielded by the cover in its closed position so that visibility and access to the attaching points to fix the escutcheon about the lock cylinder occurs only when the cover is swung open. For example, such an arrangement used on a vehicle trunk lid is disclosed in my U.S. Pat. No. 3,930,391. In such an arrangement, the cover is pivotally connected to the escutcheon and is maintained in its open position by a detent spring. The cover is automatically released from this position and returned by a return spring to its closed position when the head portion of the key which contacts a cam surface on the detent spring during unlocking is removed. Normally, all the fastening points on such an escutcheon can be located so as to be exposed with the cover in its open position but there are situations such as with a vehicle trunk lid where the allowed pivoting of the cover in the opening direction is insufficient to uncover all those areas where attachment is dictated. This may result in the case of a trunk lid, for example, when the depression normally required therein for the lock cylinder is so shallow that there is insufficient clearance to permit attaching means such as rivets to be used within the area of the escutcheon normally exposed by the cover in its open position but still within the boundary of the escutcheon. As a result, a substantially larger escutcheon and cover is then required to effect the necessary attaching points which thus adds to the cost and may be undesirable from an aesthetic point of view.

According to the present invention, there is provided an escutcheon and cover assembly with a spring biased pivot and detent or stop arrangement which effects automatic closure of the cover on its release by a detent spring operated by the key like in my U.S. Pat. No. 3,930,391 and in addition, permits the cover to also be moved in an unorthodox manner past its normal closed position to provide greater access to the face of the escutcheon for its attachment about the lock cylinder. Thus, instead of requiring a larger escutcheon and cover arrangement to obtain accessible attaching points, there is provided a built-in feature in the escutcheon and cover assembly which exposes an area of the escutcheon heretofore not normally exposed. After assembly about the lock cylinder and establishment of the cover in its normal closed position, the cover would thereafter be operated in a normal manner to expose the lock cylinder but not all the attaching points since the required movement of the cover to the escutcheon attaching position is unorthodox and therefore unobvious to the public.

An object of the present invention is to provide a new and improved excutcheon and cover assembly for a lock cylinder.

Another object is to provide an escutcheon and cover assembly for a lock cylinder wherein the cover is movable in an unorthodox manner to provide access for attachment of the escutcheon about the lock cylinder.

Another object is to provide in an escutcheon and cover assembly for a lock cylinder, a pivot and detent arrangement providing for normal opening and closing of the cover for access to and covering of the lock cylinder and in addition, unconventional movement of the cover to provide greater access to the escutcheon solely for attaching same about the lock cylinder.

These and other objects of the present invention will be more apparent from the following description and drawing in which.

Figure 1:
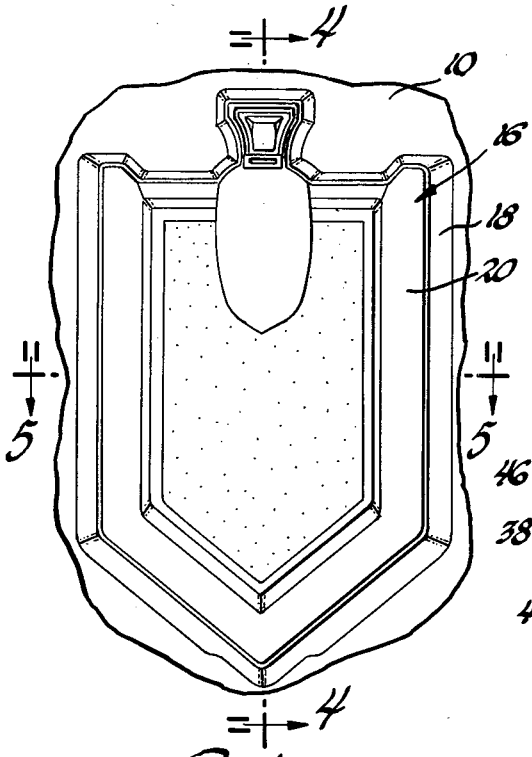
FIG. 1 is a fragmentary elevational view of a vehicle trunk lid whose lock cylinder is hidden behind an escutcheon and cover assembly according to the present invention.
Figure 2:
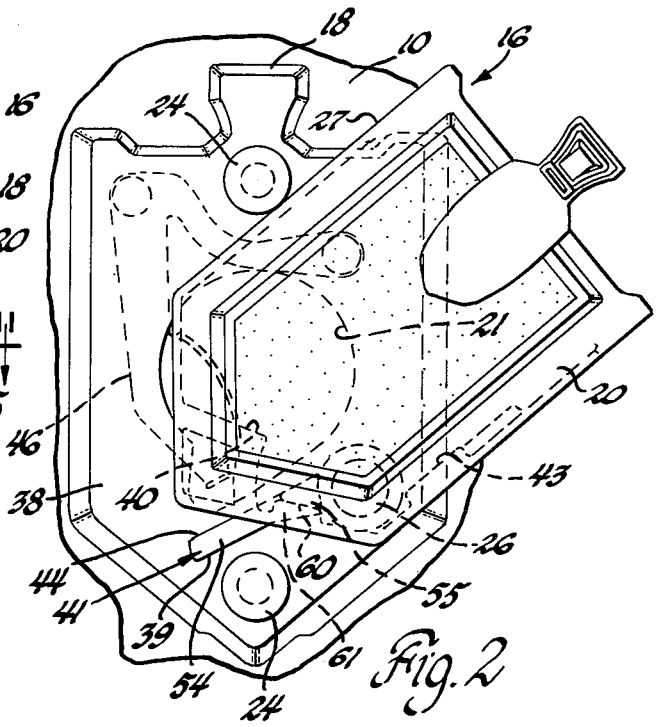
FIG. 2 is a view similar to FIG. 1 but with the cover in an escutcheon attaching position.
Figure 3:
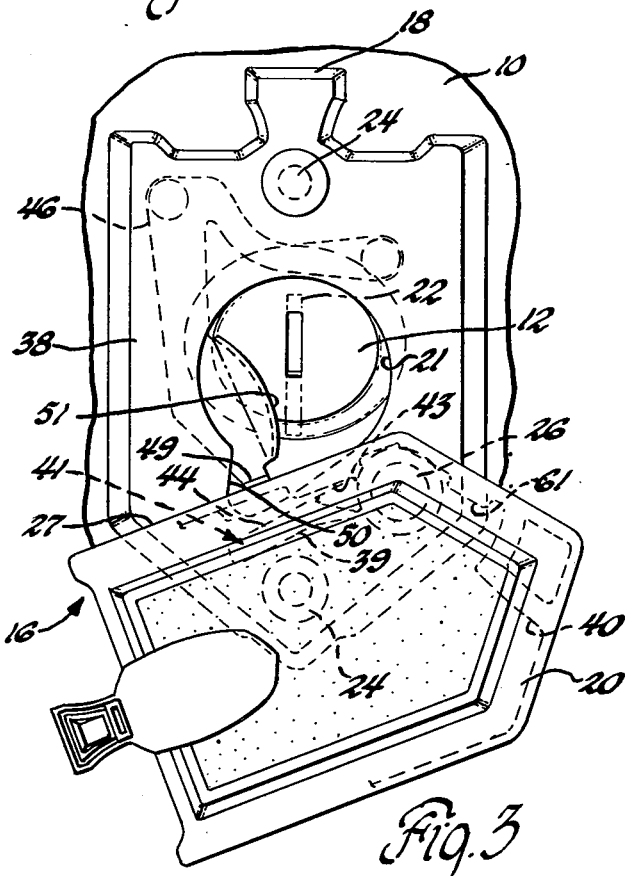
FIG. 3 is a view similar to FIG. 1 but with the cover retained in its open position.
Figure 4:
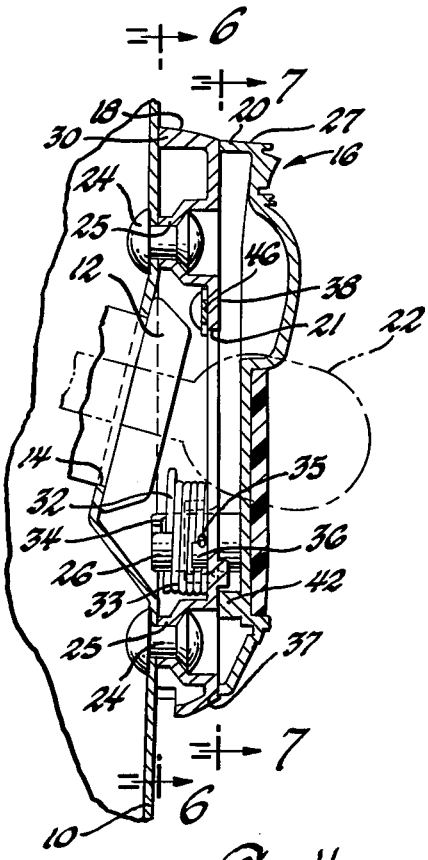
FIG. 4 is a view taken along the line 4—4 in FIG. 1.

Referring to FIGS. 1 and 4, there is shown a vehicle trunk lid 10 having a lock cylinder 12 mounted in an opening 14 in the lid. The lock cylinder is covered by an escutcheon and cover assembly 16 comprising an escutcheon 18 and a cover 20 wherein the cover is normally held in a closed position as shown in FIG. 1 and is movable with respect to the escutcheon as shown in FIG. 3 to provide access through a circular opening 21 in the escutcheon for insertion of a key 22 into the lock cylinder. The assembly 16 is secured in place by a pair of rivets 24 which fix the escutcheon 18 to the trunk lid 10 at attaching bosses 25 on the escutcheon which are located diametrically opposite each other with respect to the center of the escutcheon opening 21. The cover 20, which is pivotally connected to the escutcheon 18 prior to attachment of the latter about the lock cylinder as will be described in more detail later, covers or shields not only the lock cylinder 12 but also both the rivets 24 in its closed position. And while the cover would provide access in its open position for attaching the top rivet 24, it would not normally be further moveable but for the present invention to the position shown in FIG. 2 to provide for access to attach the lower rivet 24.

Figure 6:
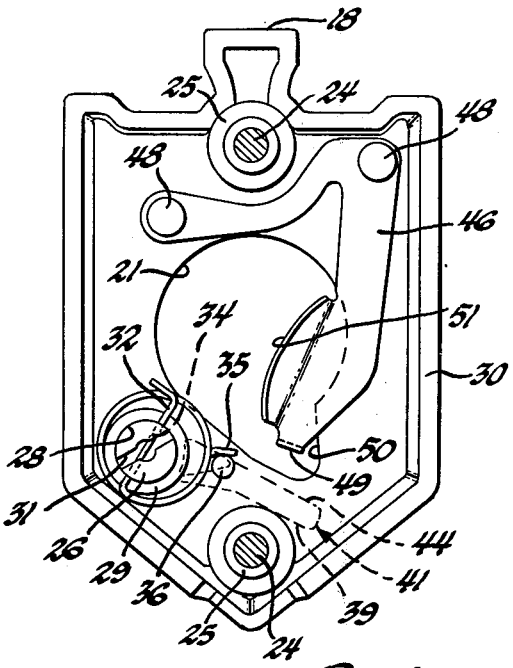
FIG. 6 is a view taken along the line 6—6 in FIG. 4.
Figure 7:
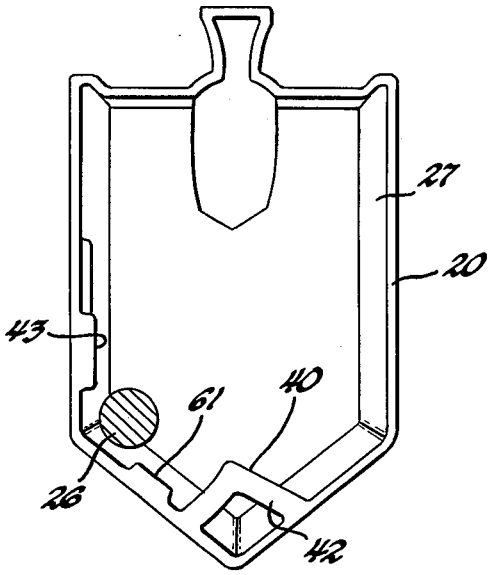
FIG. 7 is a view taken along the line 7—7 in FIG. 4.

This is accomplished with a pivot and detent or stop arrangement comprising a pivot pin 26 that is formed integral with and projects outward from the backside of the cover 20 inside a rearwardly extending border wall 27 thereof. The pivot pin 26 is located off-center in the lower right hand area of the cover as viewed from the front side and is received in a hole 28 in the escutcehon 18 surrounded by a collar or flange 29 that is formed integral with and projects outward from the backside of the escutcheon inside a rearwardly extending border wall 30 thereof. The pivot pin 26 extends past the collar 29 and has a cross slot 31 in which a straight end portion 32 of a coil spring 33 is received and trapped by notches 34 in opposite ends of the slot near the bottom thereof. The spring 33 which serves as both a return spring and a detent spring has its coils arranged about the collar 29 and has a hook 35 formed on its other end which anchors to a pin 36 that is formed integral with and projects from the backside of the escutcheon. The return-detent spring 33 holds the back rim 37 of the cover's border wall 27 against the flat face 38 of the escutcheon and its twist is such that it biases the cover 20 clockwise as viewed from the front in FIGS. 1, 2 and 3 and counterclockwise as viewed from the back in FIGS. 6 and 7. In addition, this pivot and return spring arrangement also permits the cover to be laterally moved to a limited extent away from the escutcheon to enable unorthodox movement of the cover as will be described in more detail later.

Figure 8:
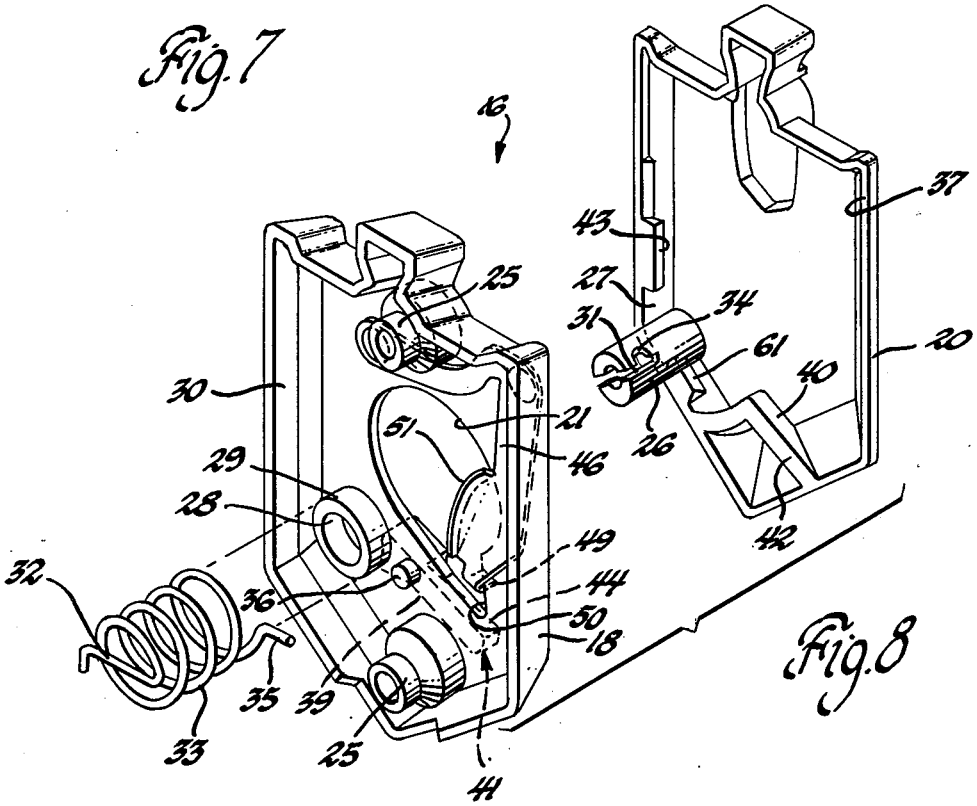
FIG. 8 is an exploded view of the escutcheon and cover assembly in the previous figures.

The escutcheon 18 and cover 20 have a first pair of cooperating detents or stops 39 and 40, respectively, which are engaged by the spring 33 to normally hold the cover in its closed position shown in FIG. 1 covering both the lock cylinder 12 and all the rivet locations 24. As best seen in FIG. 2 and 8, the escutcheon stop 39 is formed by one flat side of a stop projection 41 that is formed integral with and projects outwardly from the front side of the escutcheon and generally radially from the pivot axis. On the other hand, the cover stop 40 is formed by one flat side of an internal wall 42 that is formed integral with and projects outwardly from the backside of the cover. The internal wall 42 joins at its ends with the cover's border wall 27 and its flat stop 40 is oriented relative to the escutcheon's flat stop 39 so that they have flat surface-to-surface engagement to determine the closed cover position.

The return-detent spring 33 also holds the rim 37 of the cover against the face or front side 38 of the escutcheon while the cover is pivoted counterclockwise as viewed from the front in FIG. 3 to the normal position thereshown which provides access to the lock cylinder. However, the cover is limited in its counterclockwise rotation or opening movement by a flat stop 43 formed on the inside of its border wall 27 which contacts a flat stop 44 formed by a side of the escutcheon's stop projection 41 opposite and parallel to its close stop 39. A leaf-type detent spring 46 is secured to the backside of the escutcheon in cantilever manner by a pair of rivets 48 and has a flange 49 at its free end which extends through a notch 50 in the escutcheon face 38 joined with the key opening 21 therethrough. The detent spring flange 49 extends slightly past the face 38 of the escutcheon in the path of the cover's border wall 27 so that on movement of the cover to its open position the cover's border wall snaps past and is thereafter held by the detent spring with the result that the cover is held in its open position against the closing or return bias of the return-detent spring 33. Then when the key is inserted in the lock cylinder and turned counterclockwise to unlock the trunk lid, its head engages a cam surface 51 provided on the detent spring effecting its deflection away from the cover and moving its flange 49 out of the path of the cover 20. This permits automatic return of the cover to its closed position when the key is removed with the return-detent spring 33 then causing clockwise pivoting of the cover bringing its stop 40 against the escutcheon stop 39 and thereafter holding the cover in its normal closed position.

Figure 5:
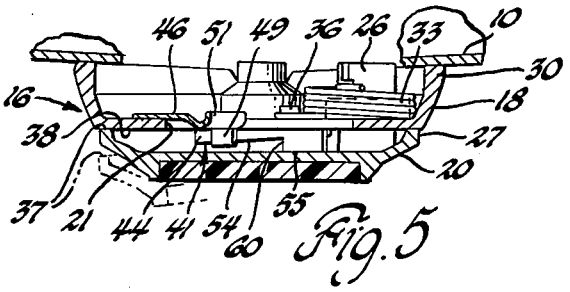
FIG. 5 is a view taken along the line 5—5 in FIG. 1.

The cover stop projection 41 not only provides for determining the closed position and limiting the opening movement of the cover against the return-detent spring 33 but also permits the cover to continue pivoting in the clockwise position past its normal position to the position shown in FIG. 2 exposing a larger face area of the escutcheon uncovering all of the rivet locations. For this purpose the top of the stop projection 41 is provided with a lower step 54 and an upper step 55 located at relatively small and large heights or distances from the face 38 of the escutcheon. The height of the lower step 54 is made less than the amount of movement that the back rim 37 of the cover is permitted to laterally move away from the escutcheon face 38 at this location by the return-detent spring 33 when the cover is lifted at a point on its edge remote from the pivot connection as shown in FIG. 5. Thus, it is only by effecting such lateral cover movement that the cover's border wall 27 is free of the close stop 39 and permitted to be pivoted clockwise past its normal closed position by the return-detent spring 33 while the spring also holds its back rim 37 in sliding engagement with the lower step 54. A stop provided by the flat riser 60 between the steps 54 and 55 is located relative to a flat stop 61 formed on the inner side of the cover's border wall 27 so that they engage to stop the cover in its escutcheon attaching position against the bias of return-detent spring 33 as shown in FIG. 2. After installation of the rivets 24, the cover is pivoted counterclockwise against the spring 33 until its close stop 40 aligns with the escutcheon's close stop 39 whereupon the return-detent spring 33 then forces the cover off the lower step 54 and back against the face 38 of the escutcheon where the spring then acts to hold the cover in its normal closed position with the stops 39 and 40 engaged. Thereafter, the cover would normally only be pivoted in one direction or counterclockwise to open for access to the lock cylinder because of the unorthodox and thus unobvious manner in which the cover must be first lifted or moved laterally and then pivoted in the opposite or counterclockwise direction to establish it in the escutcheon attaching position.

The above described preferred embodiment is illustrative of the invention which may be modified within the scope of the appended claims.

The embodiments of the invention in which an exclusive property or privilege is claimed are defined as follows:

1. An escutcheon and cover assembly for a lock cylinder mounted in a vehicle body trunk lid, said assembly comprising an escutcheon having a plurality of attaching locations to which access must be had to secure the escutcheon to the vehicle body trunk lid, said escutcheon having a face with an opening therethrough for providing access to the lock cylinder, a cover, means mounting the cover on the escutcheon for pivotal movement across said face and lateral movement to a limited extent away from said face, said cover and escutcheon having first cooperating stop means for normally engaging and stopping said cover in a closed position covering both said opening and said attaching locations when said cover is pivoted in one direction while being retained in juxtaposed relationship with said face but disengaging and permitting said cover to continue pivoting in said one direction to an escutcheon attaching position uncovering all of said attaching locations when said cover is moved away from said face a limited extent, said cover and escutcheon having second cooperating stop means for engaging and stopping said cover in said escutcheon attaching position when pivoted in said one direction from said covering position, and resilient return-detent means operatively connected between said escutcheon and said cover for biasing said cover in said one direction and also against said face of said escutcheon to normally retain said cover in its closed position and yieldingly permit pivotal movement of said cover in the opposite direction to an open position in response to a pivotal force applied to said cover in said opposite direction to provide normal access to said lock cylinder and also yieldingly permit lateral movement of said cover away from said face to disengage said first cooperating stop means in response to a lateral force applied to said cover and then force pivotal movement of said cover in said one direction to said escutcheon attaching position to provide access to said attaching locations.

2. An escutcheon and cover assembly for a lock cylinder mounted in a vehicle body trunk lid, said assembly comprising an escutcheon having a plurality of attaching locations to which access must be had to secure the escutcheon to the vehicle body trunk lid, said escutcheon having a face with an opening therethrough for providing access to the lock cylinder, a cover, means mounting the cover on the escutcheon for pivotal movement across said face and lateral movement to a limited extent away from said face, said cover and escutcheon having first cooperating stop means on the backside and face thereof respectively for normally engaging and stopping said cover in a closed position covering both said opening and said attaching locations when said cover is pivoted in one direction while being retained in justaposed relationship with said face but disengaging and permitting said cover to continue pivoting in said one direction to a escutcheon attaching position uncovering all of said attaching locations when said cover is moved away from said face a limited extent, said cover and escutcheon having second cooperating stop means on the backside and face thereof respectively for engaging and stopping said cover in said escutcheon attaching position when pivoted in said one direction from said covering position, said first and second stop means on said escutcheon comprising a stepped projection projecting outward from said face behind said cover, and a return-detent spring operatively connected between said escutcheon and said cover for biasing said cover in said one direction and also against said face of said escutcheon to normally retain said cover in its closed position and yieldingly permit pivotal movement of said cover in the opposite direction to an open position in response to a pivotal force applied to said cover in said opposite direction to provide normal access to said lock cylinder and also yieldingly permit lateral movement of said cover away from said face to disengage said first cooperating stop means in response to a lateral force applied to said cover and then force pivotal movement of said cover in said one direction to said escutcheon attaching position to provide access to said attaching locations.

3. An escutcheon and cover assembly for a lock cylinder mounted in a vehicle body trunk lid, said assembly comprising an escutcheon having a plurality of attaching locations to which access must be had to secure the escutcheon to the vehicle body trunk lid, said escutcheon having a face with an opening therethrough for providing access to the lock cylinder, a cover having a pivot pin supported in and projecting through a hole in said escutcheon whereby said cover is pivotal across said face and laterally moveable to a limited extent away from said face, said cover and escutcheon having first cooperating stop means for normally engaging and stopping said cover in a closed position covering both said opening and said attaching locations when said cover is pivoted in one direction while being retained in juxtaposed relationship with said face but disengaging and permitting said cover to continue pivoting in said one direction to an escutcheon attaching position uncovering all of said attaching locations when said cover is moved away from said face a limited extent, said cover and escutcheon having second cooperating stop means for engaging and stopping said cover in said escutcheon attaching position when pivoted in said one direction from said covering position, said first and second stop means on said escutcheon comprising a stepped projection projecting outward from said face behind said cover, said first and second stop means on said cover comprising separate stops located inside of a border wall of said cover and a return-detent spring operatively connected between said escutcheon and said pivot pin for biasing said cover in said one direction and also against said face of said escutcheon to normally retain said cover in its closed position and yieldingly permit pivotal movement of said cover in the opposite direction to an open position in response to a pivotal force applied to said cover in said opposite direction to provide normal access to said lock cylinder and also yieldingly permit lateral movement of said cover away from said face to disengage said first cooperating stop means in response to a lateral force applied to said cover and then force pivotal movement of said cover in said one direction to said escutcheon attaching position to provide access to said attaching locations.

* * * * *